United States Patent [19]

Shahar

[11] Patent Number: 4,916,760

[45] Date of Patent: Apr. 17, 1990

[54] DISPENSING DEVICE

[76] Inventor: Arie Shahar, 1314 Wellington Pl., Aberdeen, N.J. 07747

[21] Appl. No.: 261,099

[22] Filed: Oct. 24, 1988

[51] Int. Cl.[4] ..... E03D 9/02

[52] U.S. Cl. ..... 4/228; 4/222

[58] Field of Search ..... 4/227, 228, 222; 222/57, 438, 439, 446

[56] References Cited

U.S. PATENT DOCUMENTS

| | | | |
|---|---|---|---|
| 2,726,406 | 12/1955 | Vierra | 4/228 |
| 4,228,928 | 10/1988 | Hocker et al. | 4/228 |
| 4,429,809 | 2/1984 | Bousgarbiés | 4/227 |
| 4,660,231 | 4/1987 | McElfresh et al. | 4/227 |
| 4,696,414 | 9/1987 | Huat | 4/227 |

*Primary Examiner*—Linda J. Sholl

*Attorney, Agent, or Firm*—Roger A. Clapp

[57] ABSTRACT

A container for dispensing a cleaning agent into a tank through an initially sealed opening is disclosed in which a retaining hook is mounted in a recess in the container and adapted to attach the container to the tank and in which a cap is mounted over the opening and adapted to pierce the seal in the opening during installation and to automatically regulate the amount of cleaning agent passing into the tank in a controlled and adjustable manner responsive to ambient pressure changes.

13 Claims, 11 Drawing Sheets

DISPENSING DEVICE

BACKGROUND OF THE INVENTION

1. Field of the Invention

The invention relates to containers for dispensing a cleaning agent into a tank and pertains to those in which the container includes a mounting hook and a cap for piercing a seal in the container and for automatically regulating the passage of cleaning agent into the tank.

2. Description of the Prior Art

Containers for automatically dispensing a cleaning agent into a tank and containing an integral mounting hook are well known in the art. For example, U.S. Pat. No. 3,698,021 discloses a typical container for automatically dispensing a cleaning liquid and U.S. Pat. No. 3,998,360 discloses a typical container having an included mounting hook.

While these and other prior art devices can automatically dispense a cleaning agent and may include self contained mounting apparatus, they generally include moving parts which can stick or clog and they are awkward or inconvenient to use. Moreover, they are susceptible to spillage when the container is installed.

In addition, prior art dispensers which function without moving parts are unable to dispense controllable amounts of cleaning agent into the tank. Instead, the amount dispensed is dependent on the height of the flushing liquid in the tank and the amount of cleaning agent in the container.

Accordingly, one object of this invention is to achieve a container in which the dispensing mechanism easily and efficiently delivers a charge of cleaning agent in an amount controlled and adjustable by the user.

Similarly, another object of this invention is to achieve a container in which the mounting device is self contained and easy and convenient to use.

Still another object of this invention is to achieve the foregoing without suffering spillage when the container is installed.

SUMMARY OF THE INVENTION

In accordance with a preferred embodiment of this invention, a container filled with a cleaning agent and adapted to mount inversely within a tank and having an opening through which a cleaning agent can pass to the tank is combined with a cap and dispenser unit wherein the cap portion of the unit includes a shroud surrounded by a projecting collar to form a space communicating with the tank and the dispensing portion of the unit regulates the passage of the cleaning agent into the space and includes an elongated central core having an open end and a perforated closed end surrounded by a cup adapted to serve as a reservoir for cleaning agent and forming a first point permitting ambient pressure in the space to bear on cleaning agent in the reservoir, the closed end being located within the collar with the perforation therein in contact with the cleaning agent to form a second point permitting ambient pressure in the core to bear on the cleaning agent in the container whereby a pressure differential arising between the first and second points will cause flow of the cleaning agent between the container and the tank until the differential disappears.

In accordance with one feature of this invention, the duration of pressure differential can be adjustably preset by a user.

In accordance with another feature of this invention, the pressure differential is adjusted by changing the distance between the open end of the core and the open end of the shroud.

In accordance with another feature of this invention, the container is initially sealed, the closed end of the core includes cutting members adjacent to the seal and the core can reciprocate within the dispenser and press the cutting members against the seal until it perforates.

In accordance with another feature of this invention the container includes a recess and a hook unit in which the recess includes two orthogonally and oppositely disposed detents and the hook includes an elongated rod having a barb at one end adapted to engage the tank when disposed in a mounting position, a lever at the other end and two centrally located oppositely disposed pins adapted to fit in the detents and rotate the barb into the mounting position when the lever is rotated in one direction and to rotate the hook unit into the recess when rotated in the opposite direction.

A better understanding of these and other objects and features will be facilitated by reference to the following description of the drawing and detailed description of the invention.

BRIEF DESCRIPTION OF THE INVENTION

DETAILED DESCRIPTION OF THE INVENTION

Figure 1:
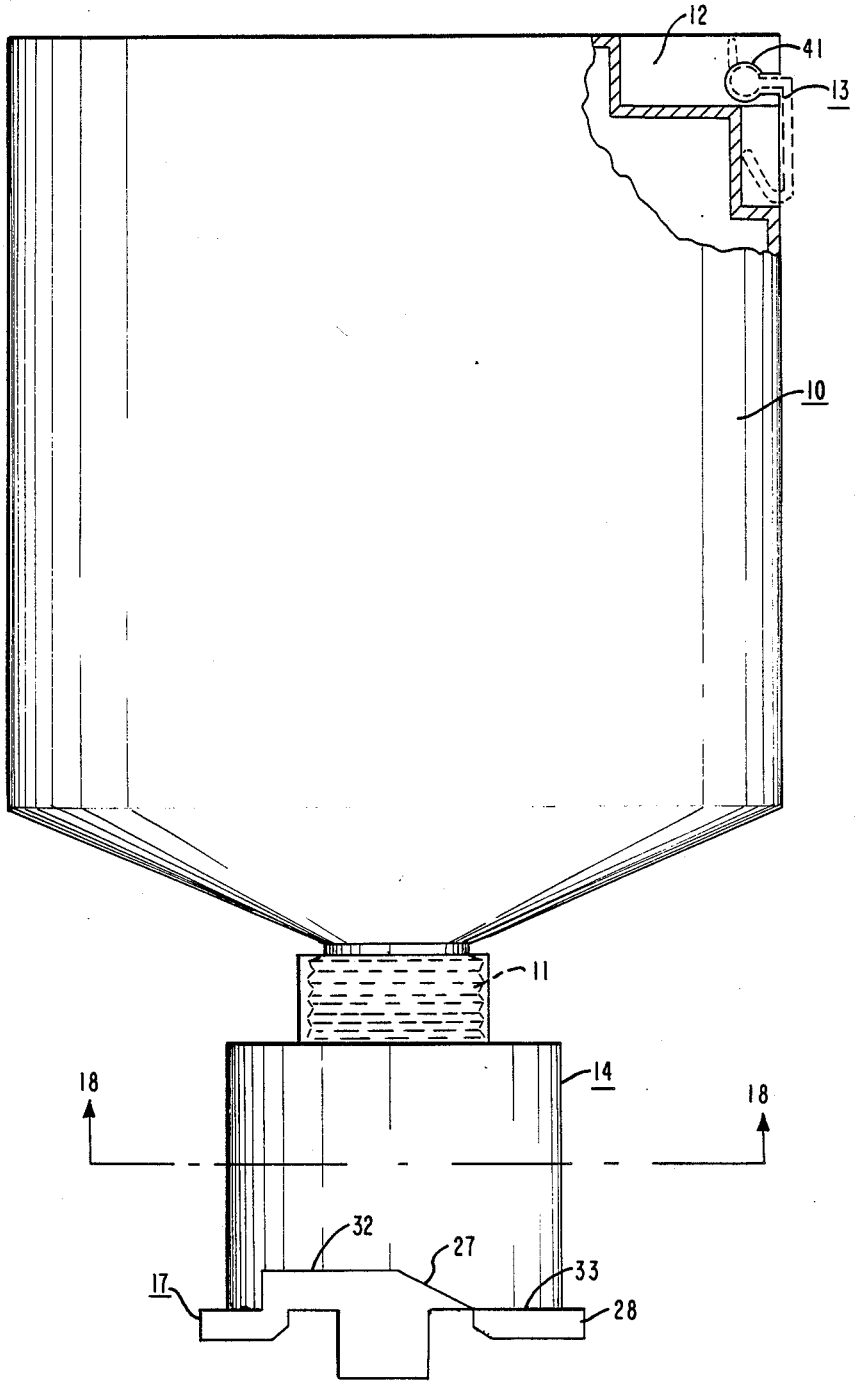
FIG. 1 is a front elevation view of a container for holding a cleaning agent enclosed by a cap unit at one end and having a recess at the other end accomodating a mounting hook unit.
Figure 2:
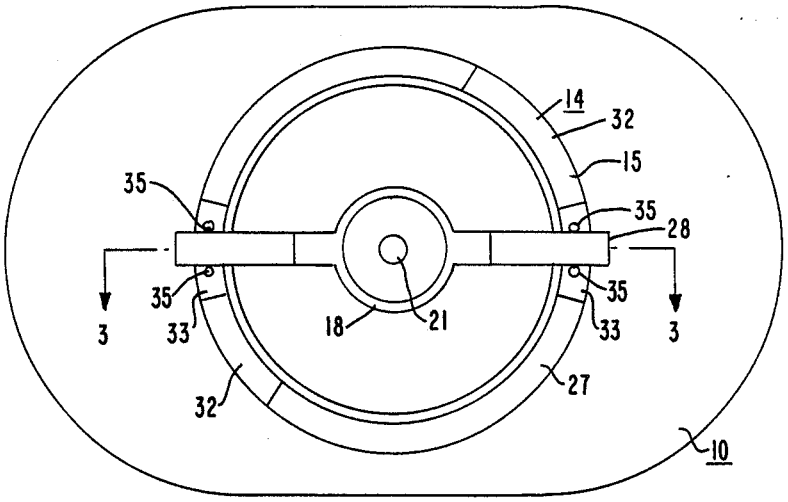
FIG. 2 is a top elevation view of the container depicted in FIG. 1.
Figure 11:
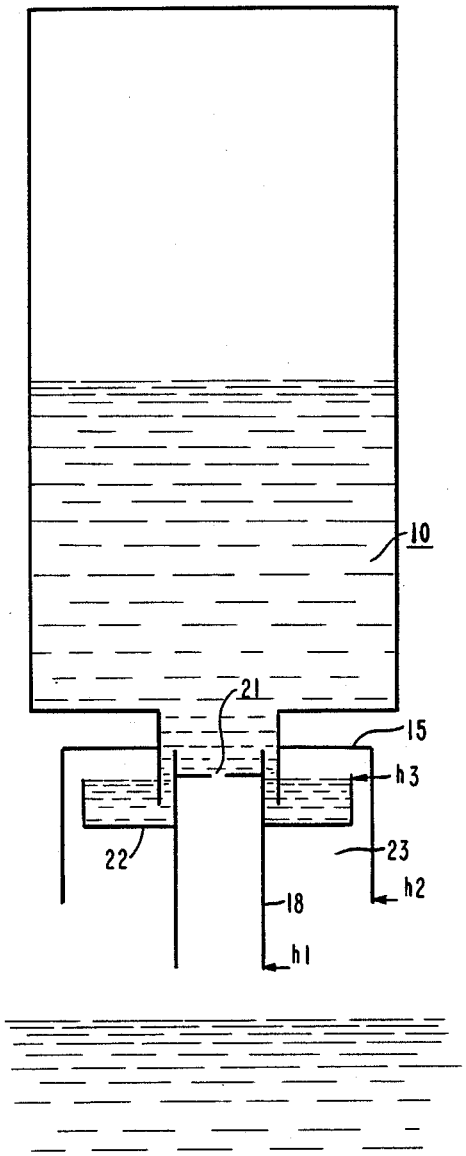
FIG. 11 is a front elevation of a schematic view of the cap and container depicted in FIG. 1 and illustrates an initial or first step in the dispensing process.

Referring to FIG. 1, a container unit 10 for holding and dispensing a cleaning agent such as a liquid antimicrobial solution is disclosed in which one end, as best seen in FIG. 11, includes an open neck 11 and in which the other end includes a recess 12 for holding a support assembly 13. In the embodiment illustrated, the neck 11 is externally threaded to accept a cap assembly 14 as shown in FIGS. 2 and 3 and the support assembly 13 is adapted to mount the container unit 10 as in a tank (not shown) so it will be immersed in a flushing liquid held by the tank.

Figure 3:
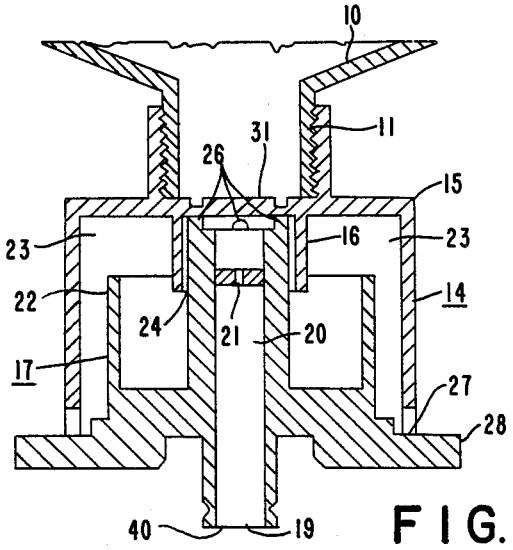
FIG. 3 is a front elevation view of the cap unit shown in FIG. 2 taken in section along the lines 3—3.
Figure 4:
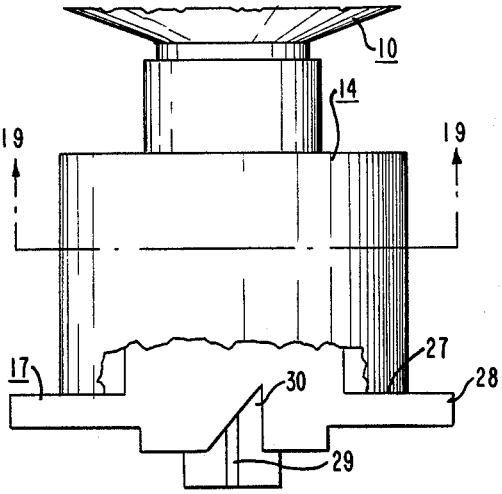
FIG. 4 is a front elevation view of a portion of the container and cap unit depicted in FIG. 1 in which the cap unit employs an alternate adjusting mechanism.
Figure 5:
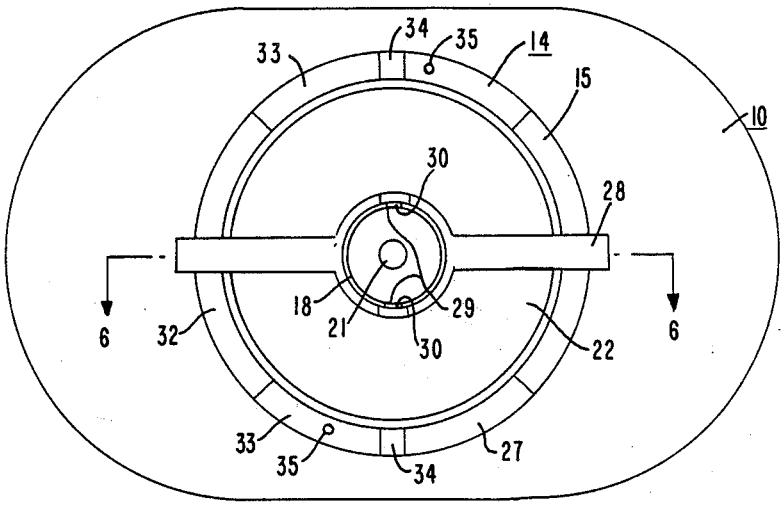
FIG. 5 is a top elevation view of the cap and container depicted in FIG. 4.
Figure 6:
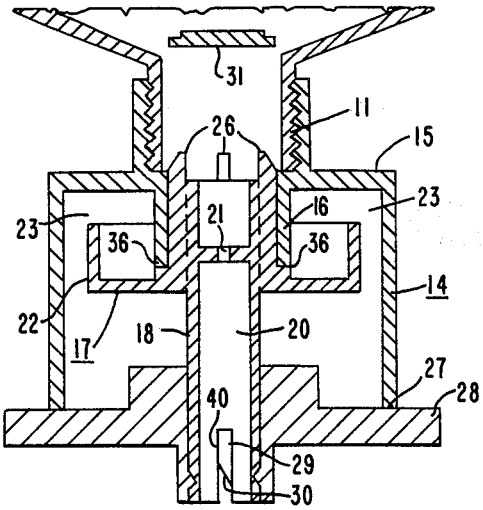
FIG. 6 is a front elevation view of a portion of the cap and container shown in FIG. 5 taken in section along the lines 6—6.
Figure 7:
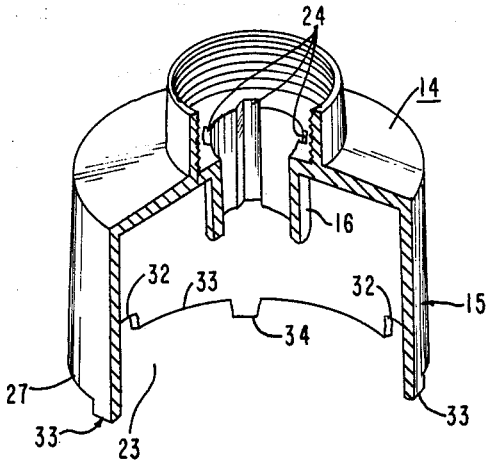
FIG. 7 is a front elevation view of a portion of the cap shown in FIG. 6 taken in perspective and having portions broken away to show interior construction.
Figure 8:
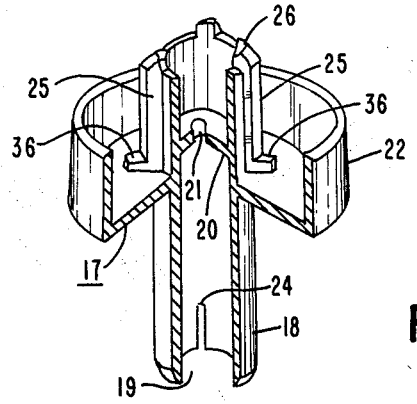
FIG. 8 is a front elevation view of another portion of the cap shown in FIG. 6 taken in perspective and having portions broken away to show interior construction.
Figure 9:
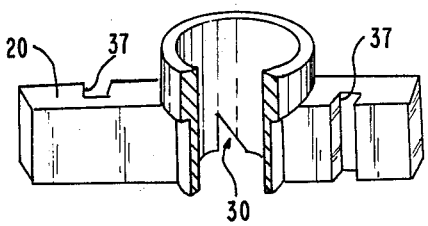
FIG. 9 is a front elevation view of another portion of the cap shown in FIG. 6 taken in perspective and having portions broken away to show interior construction.
Figure 19:
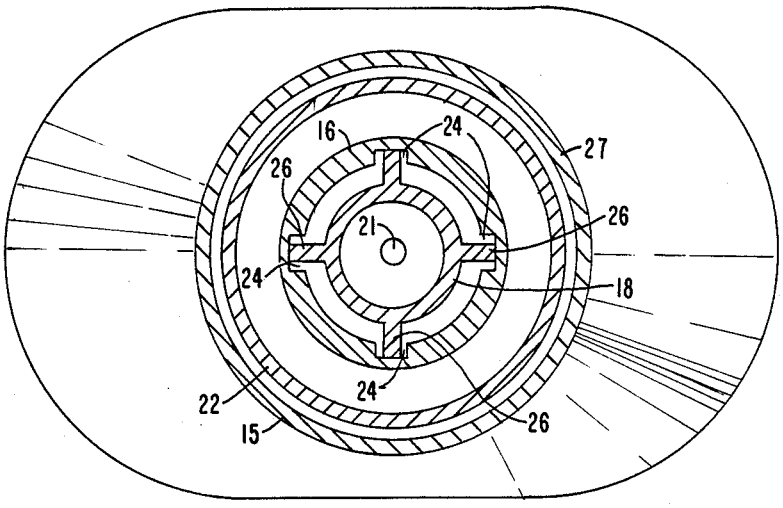
FIG. 19 is a top elevation view of the cap unit shown in FIG. 4 taken in section along the line 19—19.
Figure 20:
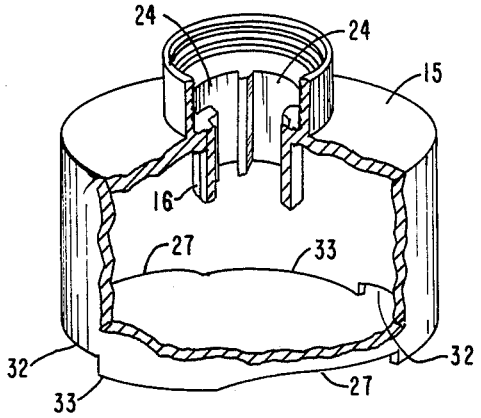
FIG. 20 is a front elevation view of a portion of the cap shown in FIG. 3 taken in perspective and having portions broken away to show interior construction.
Figure 21:
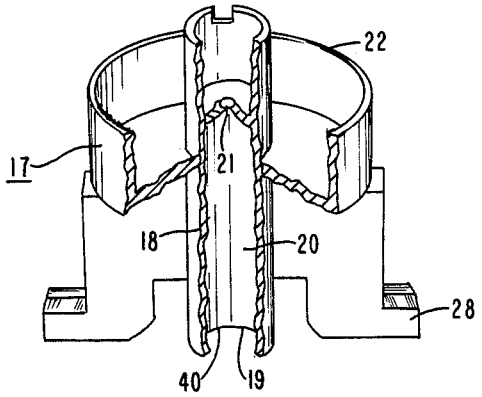
FIG. 21 is a front elevation view of another portion of the cap shown in FIG. 3 taken in perspective and having portions broken away to show interior construction.
Figure 22:
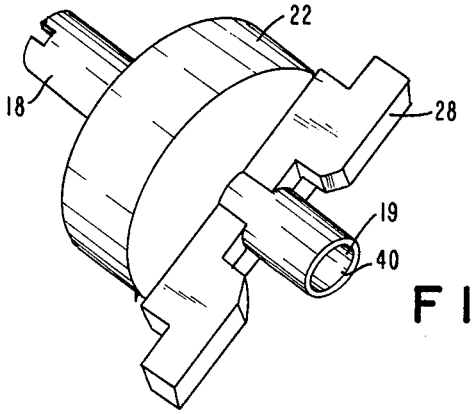
FIG. 22 is a front elevation view of another portion of the same portion of the cap shown in FIGS. 3 and 21 taken in perspective.

The cap assembly 14, as can be seen from FIGS. 3 and 6, is internally threaded to engage the threaded neck 11 and includes a dispenser unit or assembly 17 and a shroud 15 which encloses a projecting collar 16 and which, as illustrated in FIGS. 2, 3, 4, 5, 6, 7, 10, 18 and 20, terminates in a lip 27. The exterior of the collar 16 forms a space 23 communicating with the flushing liquid in a tank (not shown) and the interior of the collar 16 includes grooves 24 for passing cleaning agent from the container 10 to the space 23. The space 23 provides a barrier to the mixing of cleaning agent from the cup 22 with the flushing liquid in the tank and, as illustrated in FIG. 19, the grooves 24 can serve alternatively as stops for preventing rotation of portions of the dispenser assembly 17.

As best seen in FIGS. 5, 6, 7, 8 and 9, the dispenser assembly 17 regulates the flow of the cleaning agent into the flushing liquid in a tank (not shown) and has an elongated central core 18 having an open end 19 and a closed end 20 perforated by an orifice 21. In addition, the closed end 20 of the core 18 is surrounded by a cup 22. The closed end disposed within the collar 16 and its external surface includes ribs 26 which may advantageously terminate in cutting edge or teeth. The ribs 26 cooperate with the grooves 24 to prohibit rotation of the core 18 and, as shown in FIGS. 6, 7, 8 and 19, and form a partial passage into the cup 22 through which the cleaning agent can pass as it flows out of the container 10 through the space 23 and into the tank. As seen in FIG. 6, collar 16 is in frictional relationship with core 18 of the dispenser assembly 17 for holding the elements together during operation.

Figure 10:
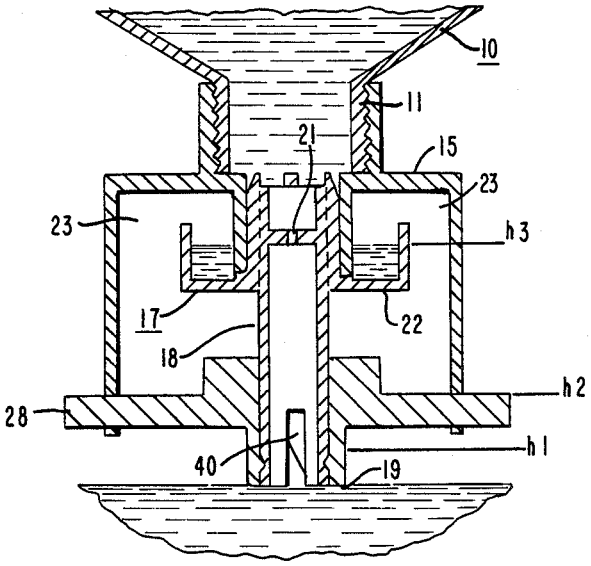
FIG. 10 is a front elevation view of the portion of the cap and container depicted in FIG. 6 and illustrates the relationship of horizontal planes containing important parts of the invention.

The open end 19 includes an adjusting arm 28 which, as illustrated in FIGS. 1, 2, 3, 18, 21 and 22, may advantageously be affixed to the core 18 or, as illustrated in FIGS. 4, 5 and 6, may be rotatably and slidably mounted on the core 18. In either case, rotation of the arm 28 changes the distance between two horizontal parallel planes h1 and h2 which are orthoganal to the opening in the container 10. As illustrated in FIG. 10, the horizontal plane h1 contains the point of opening in the open end 19 of the core 18 and h2 contains the portion of the lip 27 which lies nearest to the container 10; i.e., at a level 32.

In the embodiment illustrated in FIGS. 4, 5, 6, 7, 8, 9 and 19, the arm 28 is free to rotate on the core 18. The core 18, however, includes one or more slots 29 and the arm 28 includes one or more notches 30. The slots 29 are angled and, when the notches 30 are rotated over the slots 29, a moving point of intersection 40 is formed which, as illustrated in FIG. 10, defines the point of opening in the open end 19 of the core 18 and so lies in the horizontal plane h1. Since the planes h1 and h2 are parallel to each other, movement of the point 40 will cause the plane h1 to move relative to h2 thereby allowing the spacing between the two to be adjusted.

In another embodiment as illustrated in FIGS. 1, 2, 3, 18, 20, 21 and 22, the arm 28 is fixed to the core 18 and the lip 27 is curved, as shown in FIG. 1, to form a cam The arm 28, as can be seen from FIGS. land 2, rides on the cam surface when it is rotated by a user and causes the the point of opening in the open end 19 of the core 18, or plane h1, to reciprocate with respect to the plane h2. As h2 contains the portion of the lip 27 lying closest to the container 10, the effect, as in the first embodiment, is to change the spacing between the opening in the open end 19 of the core 18 and the point of the lip 27 lying at the level 32; i.e., closest to the container 10.

As illustrated in FIG. 6, the opening in the neck 11 is sealed by a portion 31 of the cap assembly 14 and the cutting edge or teeth located at the end of the ribs 26 bear thereon. The lip 27, in the embodiment illustrated in FIGS. 4, 5 and 6, comprises two parallel levels, i.e., the level 32 and a level 33 and one or more stops 34. In the initial, or unopened condition, the arm 28 rests on level 33 against the stop 34. At that point, the arm 28 fixes the position of the core 18 and prohibits it from being moved toward the container 10. If desired, the stop 34 can cooperate with one or more holding detents 35 to keep the arm 28 from moving until rotation is initiated by the user.

The initial position of the arm 28 (not shown) is vertical with respect to the illustration in FIG. 5. When the arm 28 is rotated to the position illustrated in FIG. 5, it will continue to be at level 33 because the teeth on the end of the ribs 26 are bearing against the portion 31 of the sealed container 10. When the user strikes the top of the arm 28 with a sharp blow, however, the teeth at the end of the ribs 26 cut through the seal and, as illustrated in FIG. 6, the portion 31 is dislodged thereby opening the container 10 to the cap assembly 14. The cup 22 may be formed with stops 36 at the ends of the ribs 26 so as to limit the travel of the core 18 when it is struck. If so, the stops 36 will prevent the core 18 from bottoming against the cup 22 and thereby insure that cleaning agent will be unblocked in its flow out of the container 10 and into the cup 22.

After the arm 28 is struck, it comes to rest on the surface 32. Thereafter, when it is rotated on the core 18, the slots 29 interact with the notches 30 and causing the point 40 to move up and down. As a result, the spacing between the planes h1 and h2 changes. Moreover, if desired, the arm 28 may be formed with indents 37 which cooperate with the stops 34 in replacement of or to supplement the detents 35.

In the other embodiment illustrated in FIGS. 1, 2, 3, 18, 20, 21 and 22, again the arm 28 is shown in the initial position. In the initial position, the arm 28 rests on level 33 of the lip 27 and thus prevents movement of the cutting edge or teeth on the end of the ribs 26 from cutting into the portion 31 of the container 10.

In this embodiment, the lip 27 is curved to form a cam surface. As best seen in FIG. 1, a combination of rotation and pushing of the arm 28 causes it to follow the cam curve of the lip 27 and thereby causes the cutting edge or teeth at the end of the ribs 26 to cut loose the portion 31 so as to break the seal in the container 10. In this position, moreover, the arm 28 is at level 32 which is nearest to the container 10. That position, however, is such that it prevents the blockage of the passageway from the container 10 to the cup 22. Thereafter, the arm 28 is counter-rotated along the cam curve of the lip 27 to obtain the desired spacing between the planes h1 and h2.

Figure 16:
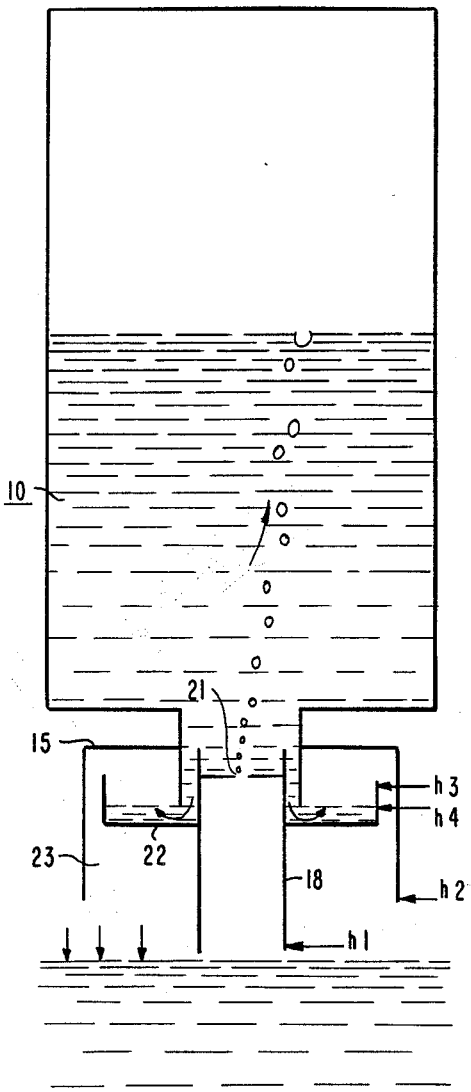
FIG. 16 is a front elevation of a schematic view of the cap and container depicted in FIG. land illustrates the final step in the dispensing process shown commencing in FIG. 10 which returns the system to its starting point.

In operation, the seal in the container 10 is broken and the unit inverted. At hat point, as illustrated in FIG. 10, the horizontal planes h1 and h2 become defined as well as a horizontal plane h3 which contains the orifice 21. At that point, the level of the flushing liquid is below h1, a vacuum will form in the container 10, ambient air will be admitted to the container 10 through the orifice 21 and the cup 22 will fill until the cleaning agent reaches the level of h3 where equilibrium is reached as illustrated in FIGS. 11 and 16.

Figure 12:
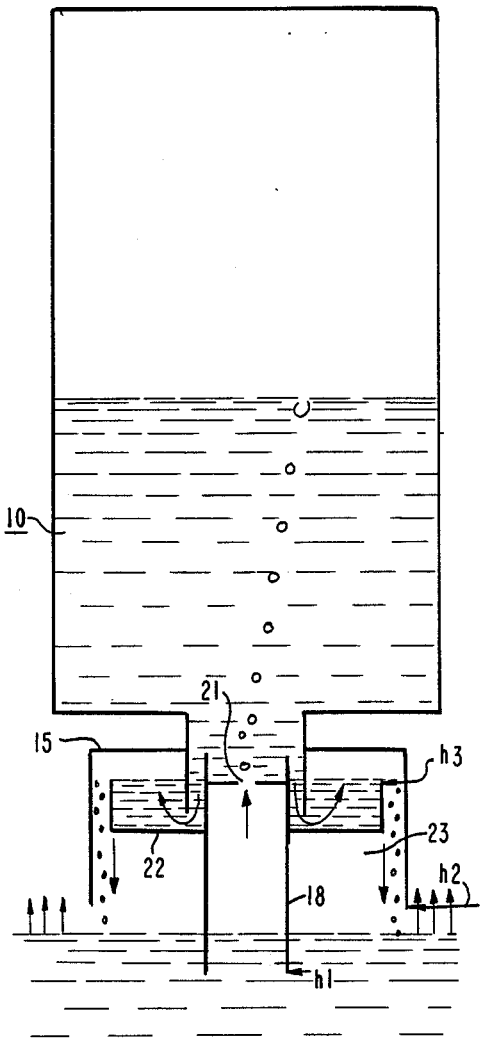
FIG. 12 is a front elevation of a schematic view of the cap and container depicted in FIG. 1 and illustrates the second step in the dispensing process shown commencing in FIG. 10 and in which cleaning agent is being forced to overflow into a flushing liquid.

When the flushing liquid rises to h1, it traps ambient air in the core 18. As the flushing liquid rises above h1, it increases the pressure on the ambient air trapped in the core 18 thereby forcing more air into the container 10 and, as illustrated in FIG. 12, causing the cleaning agent to overflow into the rising flushing liquid. Needless to say, the height of the cap 22 relative to the orifice 21 determines when cleaning agent starts to overflow. Thus, it may range from a minimum where it is level with the orifice 21 to a maximum where it leaves space between itself and the top of the shroud 15.

Figure 13:
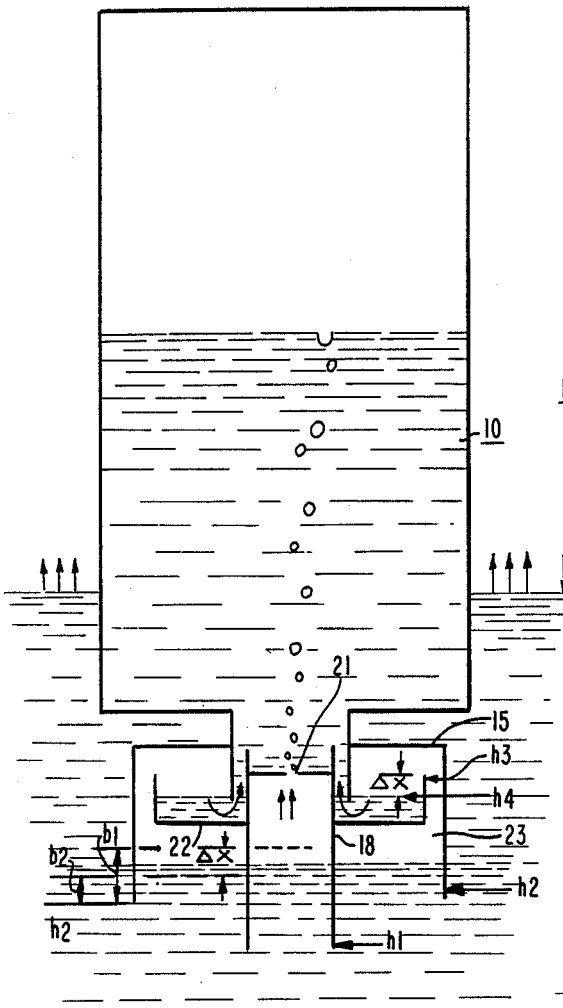
FIG. 13 is a front elevation of a schematic view of the cap and container depicted in FIG. land illustrates the third step in the dispensing process shown commencing in FIG. 10 in which the flushing liquid has reached its uppermost fill level.

When the flushing agent rises above h2, overflow of the cleaning agent stops and ambient air is trapped and begins to be pressurized in the space 23 as well as in the core 18. The pressures in the core 18 and the space 23 are not equal, so the level of flushing liquid rising in the core 18 exceeds the level of the flushing liquid rising in the space 23. As shown in FIG. 13, the spacing or distance between the levels is shown as $\Delta x$.

The existance of a $\Delta x$ in the levels, however, results in cleaning agent and air being pushed back into the container 10. As shown in FIG. 13, the cleaning agent is being pushed from the cup 22 and continues to flow until it drops a distance $\Delta x$ in the cup 22. Thus, the volume of cleaning agent (Vca) returned to the container 10 is equal to the area of the cup 22 (s1) times $\Delta x$. If the area of the cup 22 is made large with respect to the Vca, however, $\Delta x$ will approach zero; i.e., $x = Vca/S1 \rightarrow 0$.

As $\Delta x$ approaches zero, the difference between the height of the flushing liquid rising in the shroud 15 and the height of the flushing liquid rising in the core 18 will also approach zero. Thus, the pressure in the shroud 23 acting on the cleaning liquid in the cup 22 approaches the pressure acting on the air trapped in the core 18 which is being forced through the orifice 21.

When the flushing liquid reaches its filled level in the tank, it will have risen inside the core 18 and the shroud 15 an amount b1 and b2, respectively, above h2. Since it is assumed $\Delta x$ is approaching zero, the difference between b1 and b2 also approaches zero. In that case, the change in the volume of the air in the shroud 15 is equal to the area of the shroud 15 (s3) multiplied by b1 (or b2 as they are the same). Similarly, the change in the volume of the air in the core 18 is equal to the area of the core 18 (s2) multiplied by b1.

Since the air is compressed, the amount of cleaning agent which will returned to the container 10 from the cup 22 will be proportional to the change of the volume of the air in the shroud 15. The amount of air forced into the tank from the core 18 through the orifice 21 is Va and it will be proportional to the change in the volume of air in the core 18. Thus, because the flushing liquid level in the core 18 is equal to the flushing liquid level in the shroud 15 and the air pressure in the space 23 is the same as in the core 18, the coefficient of proportionality (k) is the same for both. Thus:

$$Vca = k\ (S3)\ b1 \text{ and } Va = k\ (S2)\ B1 \text{ or}$$
$$Va/Vca = S2/S3$$

From the last equation, it can be seen that as S3 becomes large with respect to S2, the volume of air (Va) forced into container 10 will become negligible. For example, a ratio of 10 to one will produce satisfactory results.

Ultimately, the flushing liquid will reach its re-fill height in the tank. At that point, it will have forced the level of the cleaning agent in the cup 22 down to a level h4 which is below h3 and, as shown in FIG. 13, is defined as $\Delta x$.

Figure 14:
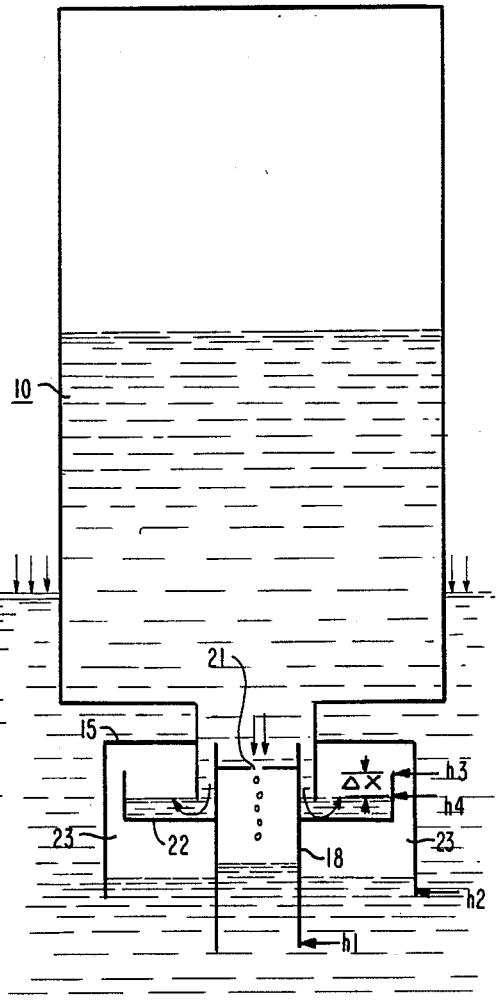
FIG. 14 is a front elevation of a schematic view of the cap and container depicted in FIG. 1 and illustrates the fourth step in the dispensing process shown commencing in FIG. 10 in which the flushing liquid starts to recede from its uppermost fill level during a flush.

When, as shown in FIG. 14, the flushing liquid begins to receed, the pressures in the space 23 and core 18 will be reduced and cleaning agent will simultaneously flow out of the container 10 through the orifice 21 and the grooves 24. The cleaning agent which returns through the grooves 24, however, is essentially the 10. same as previously forced back into the container 10. Moreover, the amount returned through the orifice 21 essentially equals the volume of air forced back into the container 10. As previously demonstrated, that amount is negligible. Thus, neither amount returned contributes to the functioning of the invention.

Figure 15:
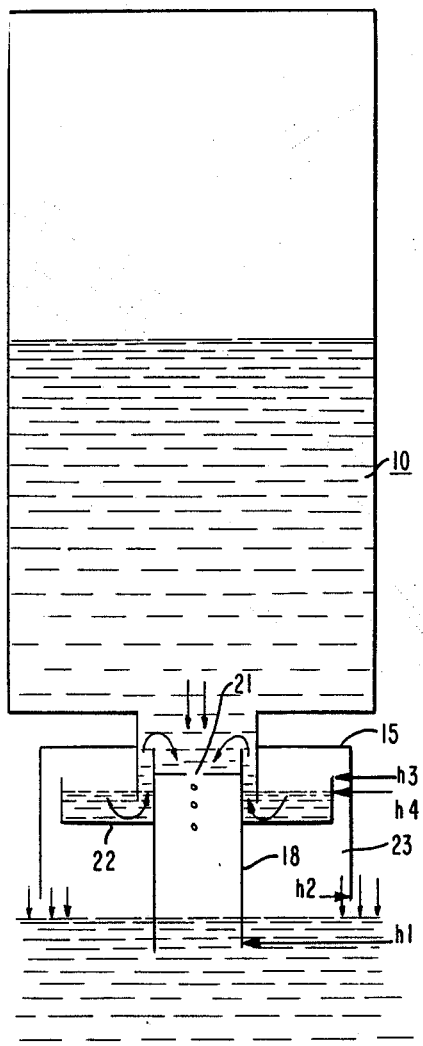
FIG. 15 is a front elevation of a schematic view of the cap and container depicted in FIG. land illustrates the fifth step in the dispensing process shown commencing in FIG. 10 in which cleaning agent is being pumped into a flushing liquid.

When the flushing liquid recedes, cleaning agent starts flowing into the cup 22. After the flushing liquid recedes past level h2, the system reverses and begins pumping cleaning agent back through the container 10 and out the orifice 21 into the flushing liquid. The pumping action, as illustrated in FIG. 15, continues until the flushing liquid recedes to level h1.

Finally, when the flushing liquid recedes below level h1, the condition illustrated in FIG. 11 is restored and the system returns to initial equilibrium and the unit is ready to start the next cycle.

In each of the filling and receding cycles of the flushing liquid, cleaning agent is either drawn or pumped out of the container 10 and into the flushing liquid in the tank. As will be recognized, both cycles are of the same duration and there is no contribution of cleaning agent from the steps illustrated in FIGS. 11, 13, 14 and 16. To the contrary, the cleaning agent passes into the flushing liquid only during the steps illustrated in FIGS. 12 and 15. Thus, the amount of c - agent dispensed depends only on the spacing between the planes h1 and h2 and the duration of the time during which cleaning agent is dispensed is a function only of the physical spacing between the planes h1 and h2.

In the first embodiment, the spacing between h1 and h2 is adjusted by interacting the slot 29 with the notch 30 so as to adjust the point 40. In the other embodiment, the point 40 is at the open end 19 of the core 18 and its position is adjusted by reciprocating the core 18 in and out of the collar 16.

Figure 17:
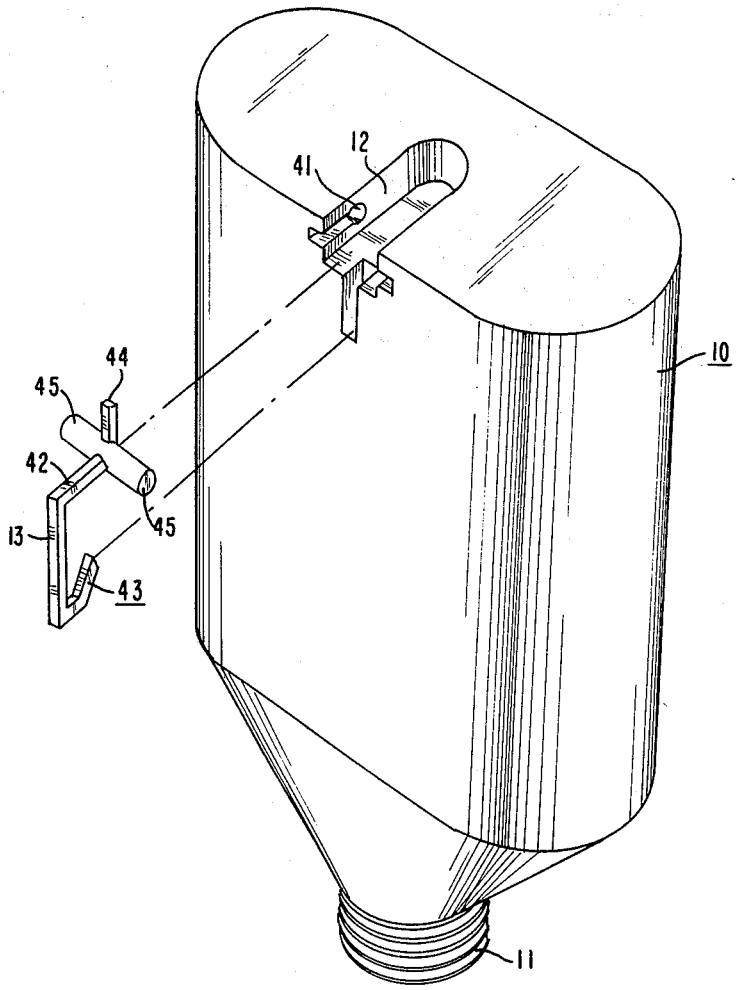
FIG. 17 is a front elevation view of the container depicted in FIG. 1 taken in perspective without the cap unit and showing a threaded opening at one end and a recess at the other end for accepting a mounting hook unit.
Figure 18:
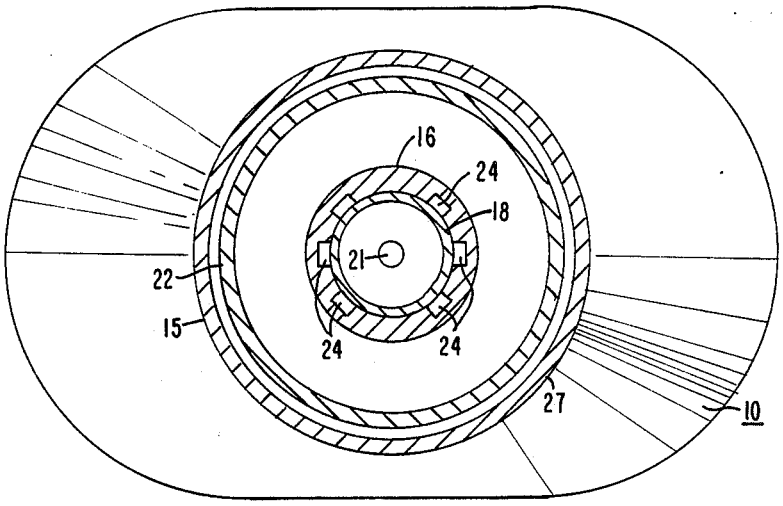
FIG. 18 is a top elevation view of the cap unit shown in FIG. 1 taken in section along the line 18—18.

As shown in FIGS. 1 and 17, the container 10 includes a self hanging feature. Specifically, the recess 12 includes a pair of oppositely disposed slotted detents 41 and the support assembly 13 comprises an elongated arm 42 having a hook 43 at one end, a lever 44 at the other end and pivots 45 intermediate the two ends. The pivots 45 fit in the detents 41 and, when so mounted, the arm 42 will be free to rotate between two positions in response to movement of the lever 44. In the first position, the hook 43 is hidden in the recess 12 and the lever 44 projects out in a position convenient to be accessed by a finger. In the second position, the lever 44 is hidden in the recess 12 and the hook 43 projects out of the recess 12 so as to readily engage the edge of a tank and thereby support the container 10.

In summary, an initially sealed container holding a cleaning agent and adapted to mount inversely within a tank filled with a flushing liquid has two openings communicating with the cleaning agent. The two openings are located within a cap and are disposed in separate planes horizontal to the plane at the top surface of the liquid in the tank. The spacing between the planes containing the openings regulates the amount of cleaning agent dispensed and is adjustable by the user so that cleaning liquid will flow and pump in a controlled volume as the liquid in the tank rises and falls. While at least one important embodiment of the invention has been disclosed, it is merely representative of the principals of the invention and it is anticipated and expected that those skilled in the art will readily recognize and utilize other embodiments falling within the scope of the invention.

What I claim is:

1. In a device for controlling the passage of a cleaning agent from a container having an opening through which the cleaning agent passes into a tank holding a flushing liquid which ebbs and flows, the combination comprising:

cap means adapted to fit said opening and having a projecting collar and a projecting shroud ending in a lip, said collar and shroud cooperating to form a space having on open end ending on a first plane wherein said first plane is disposed orthogonally to said opening, contains a portion of said lip nearest to said container and defines a first pressure interface between said cleaning agent and said flushing liquid, dispensing means for regulating the passage of said cleaning agent into said flushing liquid, said dispensing means being disposed in said space and including an elongated central core having an open end and a closed end, said open end being defined by a second plane disposed in parallel with said first plane and said closed end being perforated and surrounded by a cup, said second plane defining a second pressure interface between said cleaning agent and said flushing liquid, and adjusting means for selectively modifying the spacing between said first and second planes whereby the amount of cleaning agent flowing out of said cup and into said space on flow of said flushing liquid and and out of the perforated end of said core on ebb of said flushing liquid is regulated.

2. The combination in accordance with claim 1 wherein said space is adjusted by moving said second plane relative to said first plane.

3. The combination in accordance with claim 2 wherein said central core, said collar, said cup and said shroud are all cylindrical and concentric to each other and interstices are disposed between said cup and said collar to permit the flow there between of cleaning agent.

4. The combination in accordance with claim 3 wherein said cap means includes a portion sealed to prevent said agent from exiting said container, said core is slidably mounted within said collar, said closed end includes cutting means for puncturing said sealed portion of said cap means when slid against said cap means and said dispensing means includes slide means for sliding said core within said collar and against said sealed portion until a rupture occurs.

5. The combination in accordance with claim 4 wherein said adjusting means comprises an inclined cam disposed on said shroud at said lip and a cam follower mounted on said open end of said core to ride on said cam and impart a reciprocal motion to said core.

6. The combination in accordance with claim 5 wherein said said cam is inclined in a series of steps.

7. The combination in accordance with claim 6 wherein said steps are parallel to each other and said cam and said cam follower include a slot and a notch, respectively, adapted to to change the spacing between said first and second planes when rotated with respect to each other.

8. The combination in accordance with claim 7 wherein said core is slidably mounted in said collar and includes means for perforating said container in response to sliding movement.

9. The combination in accordance with claim 1 further including support means for mounting said container on said tank.

10. The combination in accordance with claim 9 wherein said support means comprises a recess in said container and hook means rotatably mounted in said recess to engage said tank when rotated to a mounting position.

11. The combination in accordance with claim 10 wherein said recess includes two orthogonally disposed detents and said hook means includes an elongated rod having a hook at one end adapted to engage said tank when disposed in said mounting position, a lever at the other end and two centrally located oppositely disposed pins adapted to fit in said detents and rotate said hook into said mounting position when said lever is rotated in one direction and to rotate said hook into said recess when rotated in the opposite direction.

12. In a device for controlling the passage of a cleaning agent from a container having an opening through which the cleaning agent passes into a flushing liquid which ebbs and flows out of and into a tank, the combination comprising:

cap means adapted to fit said opening and having a shroud terminating in a lip and enclosing a projecting collar to form a space having first and second passageways, said first passageway adapted to conduct cleaning agent between said space and said flushing liquid and said lip having a portion nearest to said container lying in a first plane disposed orthogonally to said opening;

dispensing means for regulating the passage of said cleaning agent into said flushing liquid, said dispensing means being mounted in said space and including an elongated central core having an open end and a closed end, said open end being disposed with its opening lying in a second plane positioned in parallel with said first plane, and said closed end being perforated by an orifice to form a third passageway for conducting cleaning agent from said container to said flushing liquid and being surrounded by a cup disposed in said collar in contact with said second passageway to form a fourth passageway through which said cleaning agent can flow, the flow of cleaning agent in said third and fourth passageways being responsive to the relative positions of said first and second planes, and regulating means for adjusting the relative positions of said first and second planes.

13. In a process for controlling the passage of a cleaning agent from a container having an opening through which the cleaning agent passes into a flushing liquid which fills and empties a portion of a tank through cap means adapted to fit said opening and having a shroud terminating in a lip and enclosing a projecting collar to form a space having first and second passageways wherein said first passageway is adapted to conduct cleaning agent between said space and said flushing liquid and said lip having a portion nearest to said container lying in a first plane disposed orthogonally to said opening and and in which dispensing means for regulating the passage of said cleaning agent into said flushing liquid is mounted in said space and includes an elongated central core having an open end and a closed end wherein said open end is disposed with its opening lying in a second plane positioned in parallel with said first plane and said closed end is perforated by an orifice to form a third passageway for conducting cleaning agent from said container to said flushing liquid and disposed within by a cup surrounding said central core so as to form a collar in contact with said second passageway and so as to form a fourth passageway through which said cleaning agent can flow, the steps of:

filling said tank with flushing liquid until it reaches a level coincident with said second plane, filling said tank with flushing liquid until it reaches a level coincident with said first plane while simultaneously forcing air into said container and cleaning agent out of said cup and into said flushing liquid, filling said tank with flushing liquid until it reaches its refill level in said tank while simultaneously forcing air into said container and cleaning agent in said cup back into said container, discharging flushing liquid from said tank until it recedes to a level coincident with said second plane while simultaneously forcing cleaning agent out of said container to refill said cup, and discharging flushing liquid from said tank until it recedes to a level coincident with said second plane while simultaneously forcing cleaning agent out of said cup, into said container and out the open end of said core.

* * * * *